United States Patent [19]

Tonges et al.

[11] 4,175,774

[45] Nov. 27, 1979

[54] NON-COPYING PRINTED DOCUMENT AND METHOD OF PRINTING SAME

[75] Inventors: Gerald A. Tonges, Sycamore Township, Hamilton County; Eugene L. Elmlinger, Springdale, both of Ohio

[73] Assignee: American Standard Inc., Cincinnati, Ohio

[21] Appl. No.: 889,229

[22] Filed: Mar. 23, 1978

[51] Int. Cl.[2] ..... B42D 15/00

[52] U.S. Cl. ..... 283/6; 283/8 R; 283/58

[58] Field of Search ..... 283/6, 8 R, 8 B, 58

[56] References Cited

U.S. PATENT DOCUMENTS

| | | | |
|---|---|---|---|
| 1,675,769 | 7/1928 | Smith | 283/8 R |
| 1,692,405 | 11/1928 | Freeman | 283/8 B |
| 3,088,841 | 5/1963 | Guertin | 283/8 R X |
| 3,282,720 | 11/1966 | Oleksiw | 283/58 X |
| 3,713,861 | 1/1973 | Sharp | 283/6 X |
| 3,852,088 | 12/1974 | Godlewski et al. | 283/8 B X |

*Primary Examiner*—Howard N. Goldberg

*Attorney, Agent, or Firm*—James W. Pearce; Roy F. Schaeperklaus

[57] ABSTRACT

A document with a background printed thereon which includes a first portion formed of small dots and a second portion formed of larger dots. The larger dots are of a size which is reproduced by a copying machine. The small dots are of a size which is not reproduced by the copying machine. When a copy is made, only the larger dots reproduce so that the copy is readily distinguishable from the original.

3 Claims, 9 Drawing Figures

NON-COPYING PRINTED DOCUMENT AND METHOD OF PRINTING SAME

This invention relates to printed documents and to a method of printing same.

With the advent of readily available copying machines which can reproduce colors with fidelity, forging of checks and the like has become a more serious problem since, if a forger can gain access to a single blank check, he can readily make numerous reproductions on such a copying machine with colored backing details faithfully reproduced.

An object of this invention is to provide a check which, when copied on such a copying machine yields a copy which can readily be distinguished from the original.

A further object of this invention is to provide a check or the like which has portions which readily are copied by the copying machine and other portions which are not reproduced thereby.

Briefly, this invention provides a check or the like having a background which is formed of dots of two different sizes or diameters, the larger dots being of a size which can be reproduced by a copying machine, the smaller dots being of a size that the copying machine cannot reproduce. A portion of the background of the check including wording for voiding the check can be formed of one size of dots while the remaining portion of the background can be formed of the other size of dots. The dots in each portion can be arranged in groups separated by spaces so that both portions can give a mottled effect. The number of the smaller dots per unit area can be sufficiently greater than the number of the larger dots per unit area that both portions can give a similar effect and the portions appear to blend into each other. However, if a copy is made, only the larger dots are reproduced so that the portion having the smaller dots appears blank in the copy.

The above and other objects and features of the invention will be apparent to those skilled in the art to which this invention pertains from the following detailed description and the drawings, in which.

In the following detailed description and the drawings, like reference characters indicate like parts.

Figure 1:
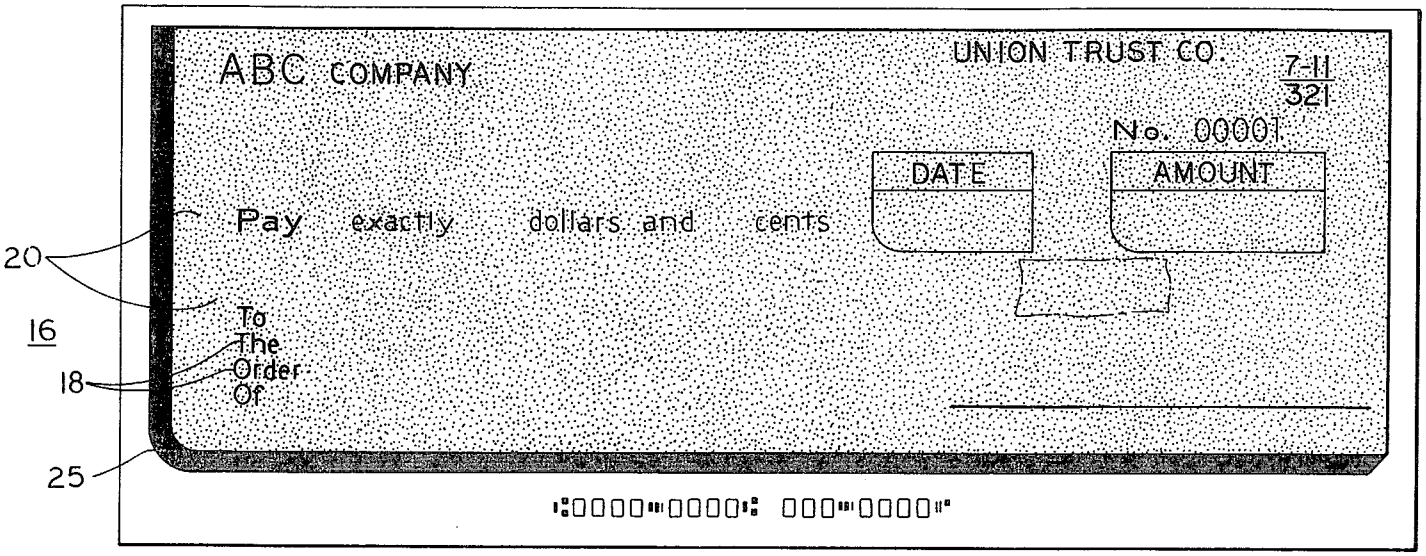
FIG. 1 is a plan view of a check constructed in accordance with an embodiment of this invention.

In FIG. 1 is shown a check 16 which can carry standard indicia 18 and which is provided with a printed background 20 in a selected color. The background 20 is made up of large dots 22 (FIG. 3) and small dots 24 arranged in a pattern on the face of the check. A border line 25 (FIGS. 1 and 2) can extend around a selected portion of the periphery of the background. The large dots 22 (FIG. 3) can be of a size which is readily reproduced by a color copying machine, such as the machine known as a Xerox 6500, a trademark of Xerox corporation. The small dots 24 can be sufficiently small in diameter that such a machine cannot reproduce them. The showing in FIG. 3 is enlarged so that the diameter of each of the dots is shown approximately 8 times the actual diameter. Each of the large dots can be approximately 1/100 inch in diameter. Each of the smaller dots can be approximately 1/200 inch in diameter.

Figure 2:
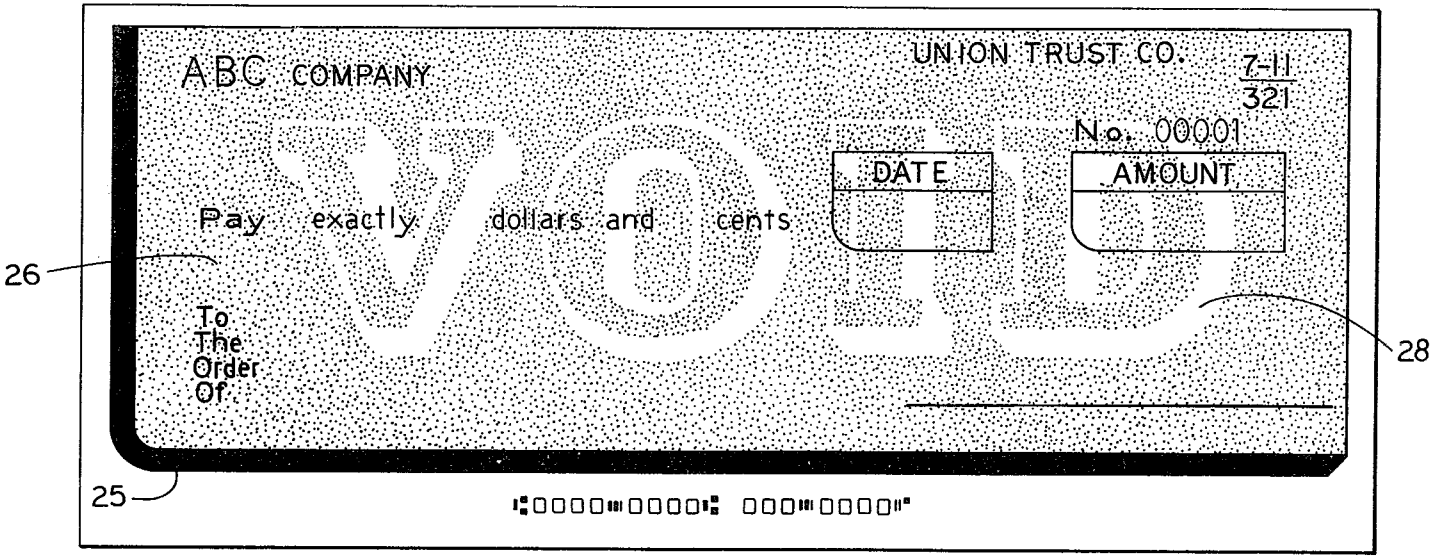
FIG. 2 is a plan view of a copy of the check illustrated in FIG. 1.
Figure 3:
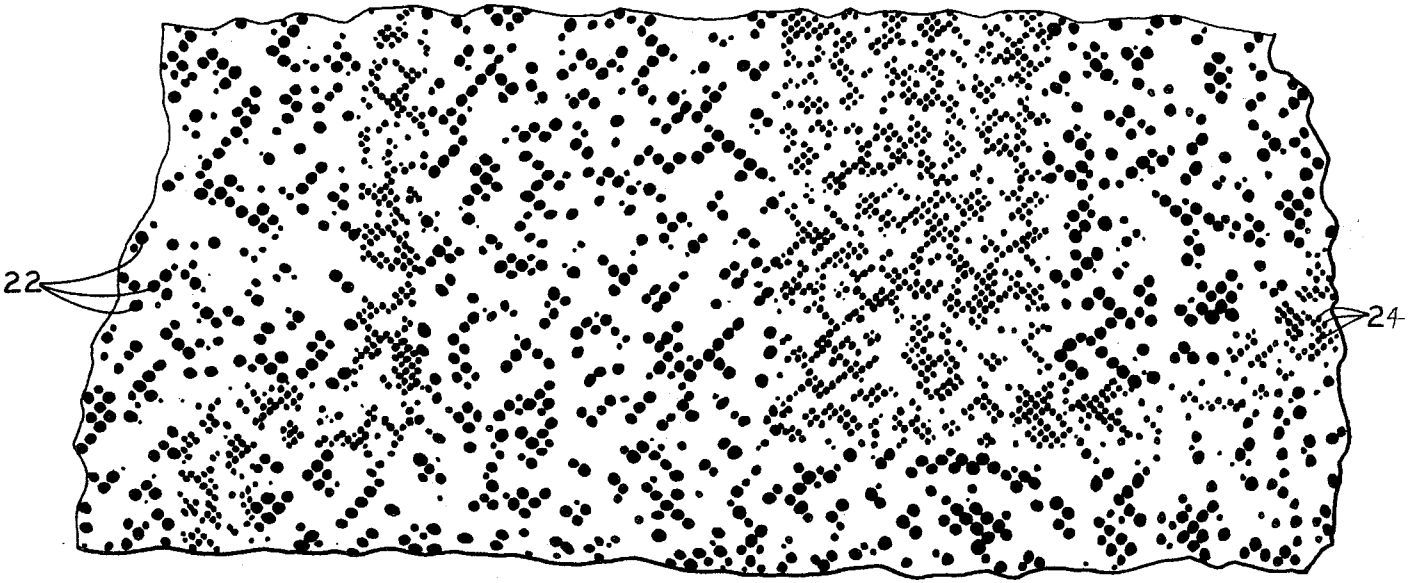
FIG. 3 is a fragmentary plan view on an enlarged scale of a portion of the check, the portion being indicated by dot-dash lines in FIG. 1.
Figure 4:
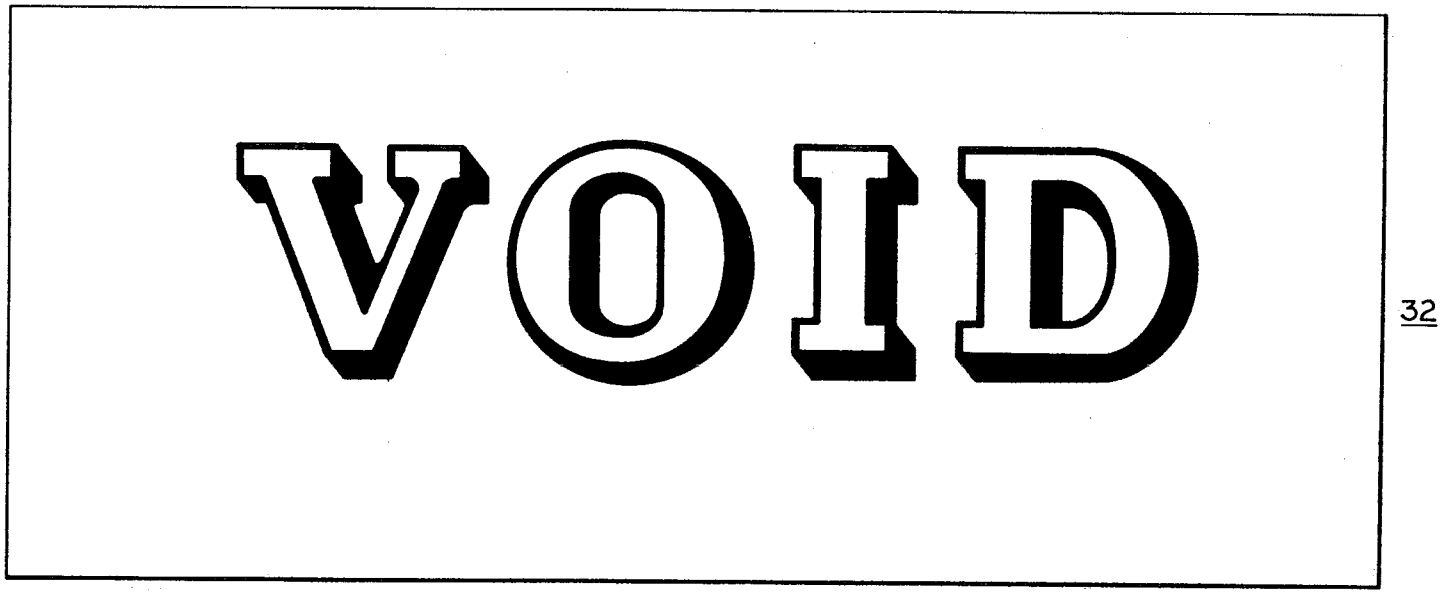
FIG. 4 is a plan view of a mask used in forming a plate from which the check is printed.

The pattern of the dots can be such that, when a copy of the check is made and only the large dots are reproduced, a copy is formed as shown at 26 in FIG. 2 in which indicia 28 is formed on the face of the check copy to invalidate the copy. The indicia 28 represents the portion of the background in small dots. The indicia appears unprinted in the copy whereas, in the check 16 (FIG. 1), all the background can give a substantially continuous and uniform appearance to the naked eye, and there is a sufficient concentration of small dots in the indicia portion to give the same effect to the human eye as the large dots in the background portion surrounding the indicia.

A plate for printing the background for the check can be formed photographically. The plate is prepared in a series of stages or steps.

Figure 5:
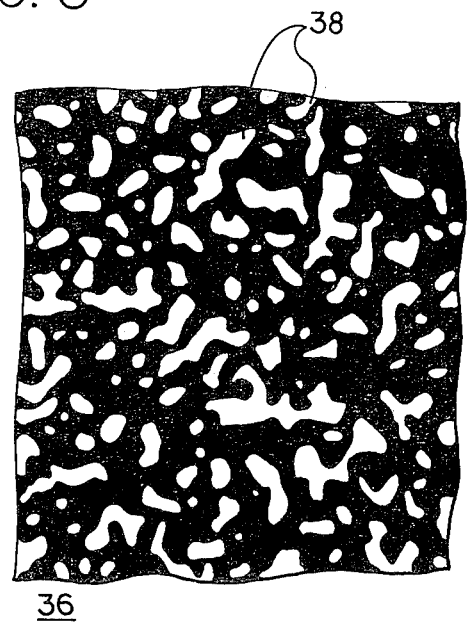
FIG. 5 is a fragmentary plan view on an enlarged scale of a portion of a mezotint mask used in forming the plate.
Figure 7:
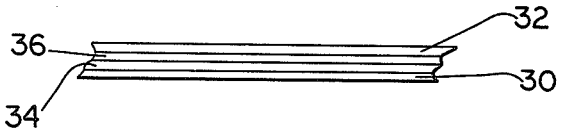
FIG. 7 is a fragmentary view in side elevation showing a first stack of elements used in forming the plate.

In the first step in a preferred method of preparing the printing plate, a photosensitized plate 30 (FIG. 7) is assembled with a mask 32, which carries a positive of the indicia, a screen 34, which can form the large dots, and a mask 36, which provides an irregular textured or mezzotint pattern. The screen 34 can be a standard 85 line 30 percent screen. The mask 36 can have an irregular pattern as shown at 38 in FIG. 5. In FIG. 5, the design is shown on the same enlarged scale (8 diameters) as in FIG. 3. The mask 36 can be formed as a negative of a standard heavy mezzotint design such as that known as CHARTPAK Cat. No. PT009, a trademark of Chart-Pak, Incorporated. The plate is exposed in this first assembly.

Figure 8:
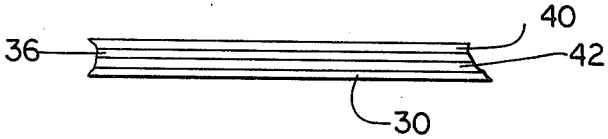
FIG. 8 is a fragmentary view in side elevation of a second stack of elements used in forming the plate.
Figure 9:
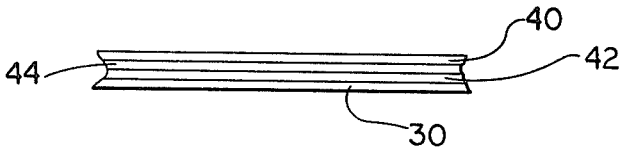
FIG. 9 is a fragmentary view in side elevation of a third stack of elements used in forming the plate.

In a second step of the preferred method (FIG. 8), the sensitized plate 30 is assembled with a mask 40, which can be a negative of the mask 32, a screen 42 which can form the small dots, and the mezzotint mask 36. The screen 42 can be a standard 150 line 15 percent screen. The relationship between the plate 30 and the mezzotint mask 36 in step 2 can be the same as in the first step. The indicia on the negative mask 40 can be in the same position relative to the plate 30 in the second step as the indicia of the mask 32 in the first step. The plate is exposed in this second assembly.

Figure 6:
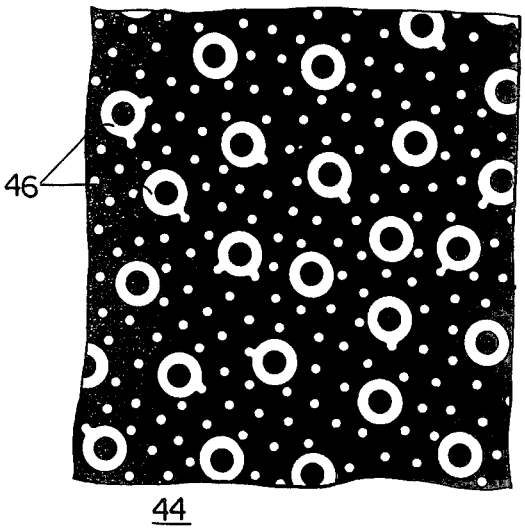
FIG. 6 is a fragmentary plan view on an enlarged scale of a patterned mask used in forming the plate.

In a third step of the preferred method, the sensitized plate 30 is assembled with the mask 40, the screen 42, and a patterned mask 44. The relationship between the plate 30, the mask 40, and the screen 42 can be the same in the third step as in the second step. The mask 44 can have the pattern shown in FIG. 6 at 46. In FIG. 6, the design is shown on the same enlarged scale (8 diameters) as the showing in FIG. 3. The pattern is selected to add sufficient small dots to those already on the plate so that the concentration of small dots is sufficient to give the same effect to the human eye in the indicia portions as is provided by the large dots in the other portions of the background. The mask 44 can be a negative of a commercial design known as FORMATT No. 7115, a trademark of Graphic Products Corporation. The plate is exposed in this third assembly.

After having been exposed, the plate is developed in the usual way and is used for printing the background of checks in the usual fashion.

The check is shown with the indicia portion of the background in small dots and the remaining portion of the background in large dots. However, the indicia portion of the background can be printed in large dots and the remaining portion of the background can be printed in small dots.

The pattern of the document background is subject to variation withing the scope of the appended claims.

Having described our invention, what we claim as new and desire to secure by letters patent is:

1. A document including a sheet and a background printed on the sheet, the background including a first portion formed of small dots and a second portion formed of larger dots, the dots being of a single color, the larger dots being of a size which is reproduced by a copying machine, the small dots being of a size which is not reproduced by the copying machine.

2. A document as in claim 1 in which the portions of the background are so arranged that when a copy of the document is made in which the larger dots are reproduced but the small dots are not reproduced, indicia is formed to void the document.

3. A method of printing a document which includes printing a first portion of a background of the document in small dots which will not reproduce on a copying machine and printing a second portion of the background in larger dots which will reproduce on the copying machine, the dots being of a single color, whereby, when a copy of the document is made, only the second portion of the background is reproduced, and the first portion of the background is not reproduced.

* * * * *

REEXAMINATION CERTIFICATE (672nd)

United States Patent [19] [11] B1 4,175,774

Tonges et al. [45] Certificate Issued Apr. 28, 1987

[54] NON-COPYING PRINTED DOCUMENT AND METHOD OF PRINTING SAME

[75] Inventors: Gerald A. Tonges, Sycamore Township, Hamilton County; Eugene L. Elmlinger, Springdale, both of Ohio

[73] Assignee: Bedinghaus Business Forms Inc., Cincinnati, Ohio

Reexamination Request:
No. 90/000,938, Jan. 14, 1986

Reexamination Certificate for:

| | |
|---|---|
| Patent No.: | **4,175,774** |
| Issued: | **Nov. 27, 1979** |
| Appl. No.: | **889,229** |
| Filed: | **Mar. 23, 1978** |

[51] Int. Cl.[4] ..... B42D 15/00
[52] U.S. Cl. ..... 283/94; 283/58; 283/93; 283/902
[58] Field of Search ..... 283/58, 93, 94, 902

[56] References Cited

U.S. PATENT DOCUMENTS

| | | | |
|---|---|---|---|
| 3,675,948 | 7/1972 | Wicker | 283/902 |
| 3,784,289 | 7/1974 | Wicker | 356/150 X |
| 4,168,088 | 9/1979 | Somlyody | 283/93 |
| 4,210,346 | 7/1980 | Mowry, Jr. et al. | 283/93 |
| 4,227,719 | 10/1980 | McElligott et al. | 283/58 X |
| 4,227,720 | 10/1980 | Mowry, Jr. et al. | 283/58 X |
| 4,265,469 | 5/1981 | Mowry, Jr. et al. | 283/58 X |
| 4,310,180 | 1/1982 | Mowry, Jr. et al. | 283/93 |

OTHER PUBLICATIONS

Memo of Xerox Corp. from R. F. Lohman to A. Morganstein, dated May 25, 1975.

*Primary Examiner*—Paul A. Bell

[57] ABSTRACT

A document with a background printed thereon which includes a first portion formed of small dots and a second portion formed of larger dots. The larger dots are of a size which is reproduced by a copying machine. The small dots are of a size which is not reproduced by the copying machine. When a copy is made, only the larger dots reproduce so that the copy is readily distinguishable from the original.

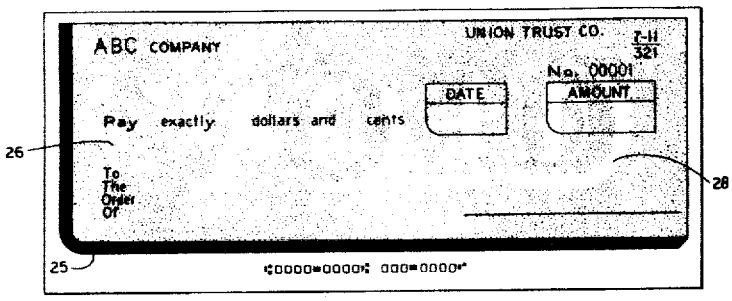

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-3 are cancelled.

* * * * *